US010058472B2

(12) United States Patent
Laudani

(10) Patent No.: US 10,058,472 B2
(45) Date of Patent: Aug. 28, 2018

(54) HOUSING FOR COFFINS

(71) Applicant: Pietro Laudani, Boleslawiec (PL)

(72) Inventor: Pietro Laudani, Boleslawiec (PL)

( * ) Notice: Subject to any disclaimer, the term of this patent is extended or adjusted under 35 U.S.C. 154(b) by 0 days.

(21) Appl. No.: 15/541,374

(22) PCT Filed: Feb. 17, 2016

(86) PCT No.: PCT/IB2016/050845

§ 371 (c)(1),
(2) Date: Jul. 2, 2017

(87) PCT Pub. No.: WO2016/132301

PCT Pub. Date: Aug. 25, 2016

(65) Prior Publication Data

US 2017/0360640 A1 Dec. 21, 2017

(51) Int. Cl.
*A61G 17/02* (2006.01)
*A61G 17/007* (2006.01)

(52) U.S. Cl.
CPC ..... *A61G 17/02* (2013.01); *A61G 17/007* (2013.01); *A61G 2203/76* (2013.01)

(58) Field of Classification Search
CPC .... A61G 17/02; A61G 17/007; A61G 17/036; A61G 17/042; A61G 17/0405; A61G 17/0136; A61G 2203/76; B65D 7/38; B29C 65/36; B29C 65/364
USPC ..... 27/14, 17, 19, 7, 35; 220/612, 613; 156/272.2, 272.4
See application file for complete search history.

(56) References Cited

U.S. PATENT DOCUMENTS 1,369,919 A * 3/1921 Eliel ..... B65D 53/06 219/243
1,719,364 A * 7/1929 Gilkey ..... A61G 17/00 190/27
1,818,485 A * 8/1931 Lambert ..... A61G 17/02 219/243
1,863,855 A * 6/1932 Jenkins ..... A61G 17/02 27/17
2,375,386 A * 5/1945 Rick ..... A61G 17/02 220/613
2,744,655 A * 5/1956 Vnuk ..... B29C 65/3444 156/272.2

(Continued)

FOREIGN PATENT DOCUMENTS

EP 2329805 A2 * 6/2011 ..... A61G 17/08

*Primary Examiner* — William L Miller
(74) *Attorney, Agent, or Firm* — R. Ruschena Patent Agent, LLC

(57) ABSTRACT

A housing for keeping, transporting and entombing a corpse comprising a bottom with an outer peripheral edge and a lid (2) with an outer peripheral edge, which can be superimposed perfectly between each other, characterized in that between the edge of the bottom and the edge of the lid, along the whole perimeter it is interposed a wire frame section bar, flat, with opened junction, of highly resistant metal, wherein at the ends of the opened junction electric cables are connected, said wire frame section bar being configured so that it allows an extended contact between the edge of the bottom and the edge of the lid in the internal areas of said wire frame section bar, thus providing by current flowing, the welding and the sealing of the peripheral edges of the lid and the bottom.

7 Claims, 2 Drawing Sheets

(56) References Cited

U.S. PATENT DOCUMENTS

| | | | | | |
|---|---|---|---|---|---|
| RE26,374 | E * | 4/1968 | Beery | F24D 13/02 | 156/179 |
| 3,525,132 | A * | 8/1970 | Gauchard | A61G 17/007 | 27/19 |
| 4,029,837 | A * | 6/1977 | Leatherman | B29C 37/0082 | 156/272.4 |
| 4,313,777 | A * | 2/1982 | Buckley | B29C 66/45 | 156/157 |
| 4,586,624 | A * | 5/1986 | Shaw | B29C 65/342 | 156/273.9 |
| 4,743,320 | A * | 5/1988 | Shaw | B29C 65/342 | 156/273.9 |
| 5,471,718 | A * | 12/1995 | Harrill | A61G 17/00 | 220/669 |
| 6,901,640 | B2 * | 6/2005 | Sevey | A61G 17/00 | 27/19 |
| 2006/0124652 | A1 * | 6/2006 | Ohtsuki | B29C 65/02 | 220/612 |
| 2014/0223706 | A1 * | 8/2014 | Abrams | A61G 17/007 | 27/3 |

* cited by examiner

HOUSING FOR COFFINS

BACKGROUND OF THE INVENTION

1. Field of the Invention

The present invention relates to a new housing apt to be introduced inside wooden burial caskets or used as it is for keeping, transporting and entombing a corpse.

Said housing for coffins is the upholstery or inner lining of a casket to guarantee that the fluids released by the body during the decomposition are sealed. Said housing can also be used as a real coffin, for example in case of transport of bodies after an accident from the place of the accident to the mortuary for carrying out the autopsy and the laying out of the corpse, or in case of natural calamities when it is needed to park a corpse for long, or for the transport of not laid out corpses from the entombment area to the crematorium.

2. Description of Related Art

As it is known, up to now, in order to guarantee the perfect tightness of cadaveric fluids or putrefying gases, the law establishes that the coffin intended for entombment is fire closed or closed by means of any other similar method. The traditional method of sealing is carried out by a welder who alloys tin and lead, as weld material, to join lid and container which are typically realized in galvanized iron. Such system is considered cheap and very reliable, but it needs good manual skills of the gravedigger who carries out the seal as well as a long time for the whole operation.

Moreover, at the state of the art there are not known more efficient systems to guarantee a perfect tightness and a rapid closing of a casket.

Therefore, there is the need for an innovation which allows a more rapid and safer sealing of a casket.

Brief Summary of the Invention

Therefore, object of the present invention is a housing comprising a bottom and a lid, separated before usage, whose sealing is guaranteed by welding the bottom to the lid by means of an original electro-fusion technology.

The present invention solves the drawbacks of the traditional system thanks to a new housing and welding by means of an original electro-fusion technology.

The housing for containing a corpse comprises a bottom and a lid both provided with an outer peripheral edge. Between the two peripheral edges, along the whole perimeter, it is interposed a flat section bar with opened junction, of highly resistant metal, characterized by a wire frame. At the ends of the opened junction electrical cables are connected. The wire frame is configured so that, when current passes there through, said wire frame and the outer peripheral edge of the bottom and of the lid melt together, thus providing the welding and the sealing of the peripheral edges of the lid and the bottom. In other words said wire frame structure allows an extended contact between the edge of the bottom and the edge of the lid in the internal areas of the wire frame.

According to another aspect, it is described a method for welding and sealing the housing.

Further preferred and/or particularly advantageous embodiments of the housing and method for welding and sealing are described in the appended dependent claims according to the features described.

BRIEF DESCRIPTION OF THE SEVERAL VIEWS OF THE DRAWINGS

These and other advantages will be described in detail in the following with reference to the appended drawings, in which.

DETAILED DESCRIPTION OF THE INVENTION

Figure 1:
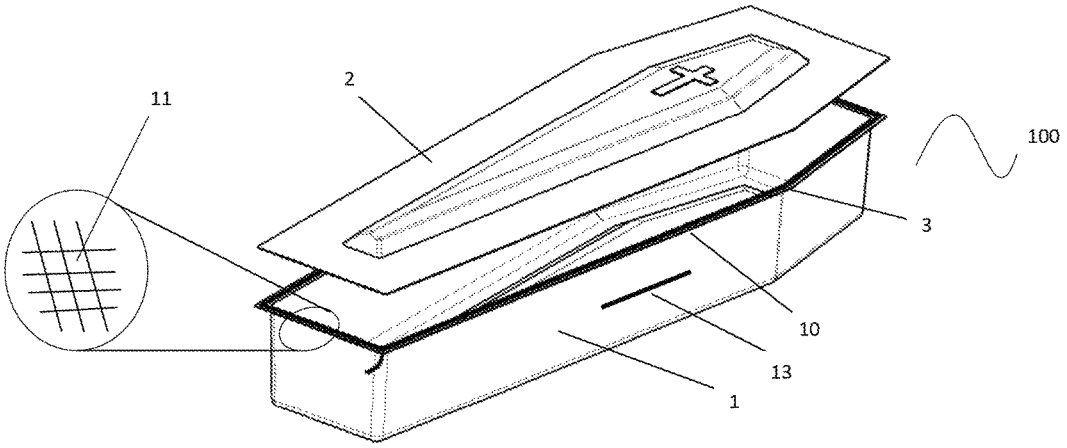
FIG. 1 shows an overall axonometric view of the housing for coffins and a detail of the a flat section bar with wire frame according to the present invention.
Figure 2:
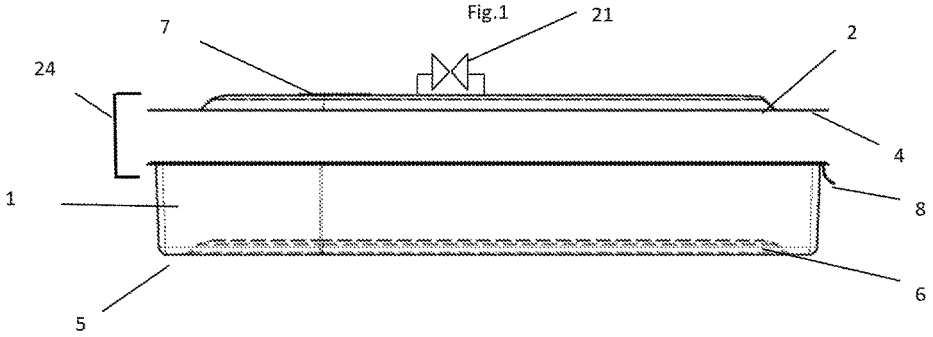
FIG. 2 shows a longitudinal view of the housing of FIG. 1.
Figure 3:
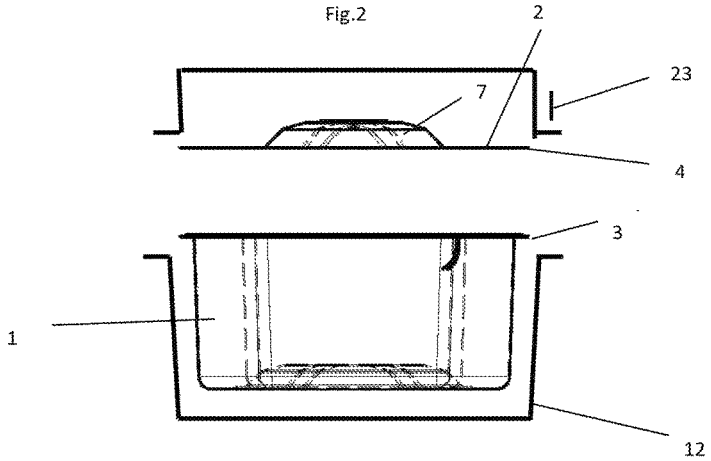
FIG. 3 shows a side view of the housing of FIG. 1.
Figure 4:
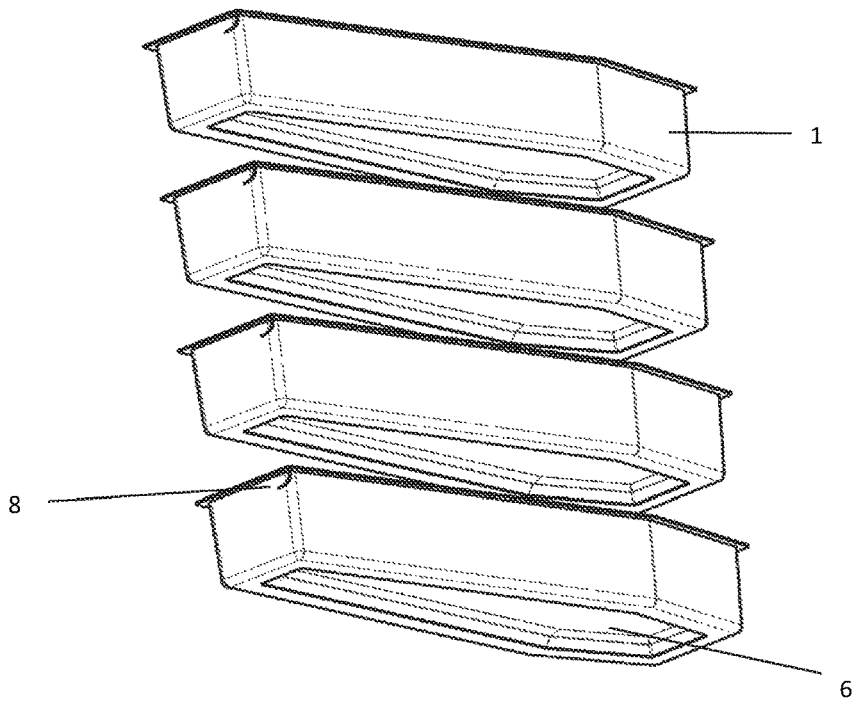
FIG. 4 shows a panoramic view of the rear portion of more housings, which can be stacked the one on the other one.

As it is shown in the appended drawings, object of the present invention is a housing 100 comprising a bottom 1 and a lid 2 both in plastic material, apt to be introduced inside wooden burial caskets 12 or used as it is for keeping, transporting and entombing a corpse. The bottom 1 and the lid 2 are clearly separated before usage. It is to be intended that the plastic material can be of any type and in particular it will comprise materials which can be used in the extrusion of plates comprising the biodegradable ones with polymers deriving from agriculture products or amino acids, or other incineration-friendly polymer materials. In an embodiment of the invention, the housing 100 is provided with two belts 13, suitably positioned for manually lifting and transporting the same housing, and with a plurality of ribs 6 on the lower surface 5 of the bottom 1, as it is shown in FIG. 2. Said ribs 6, in addition to allow a perfect stacking of the housings the one on the other one (FIG. 4), allow also a safe and simple mechanic lifting of the same housings, for example by means of a lift truck.

Figure 5:
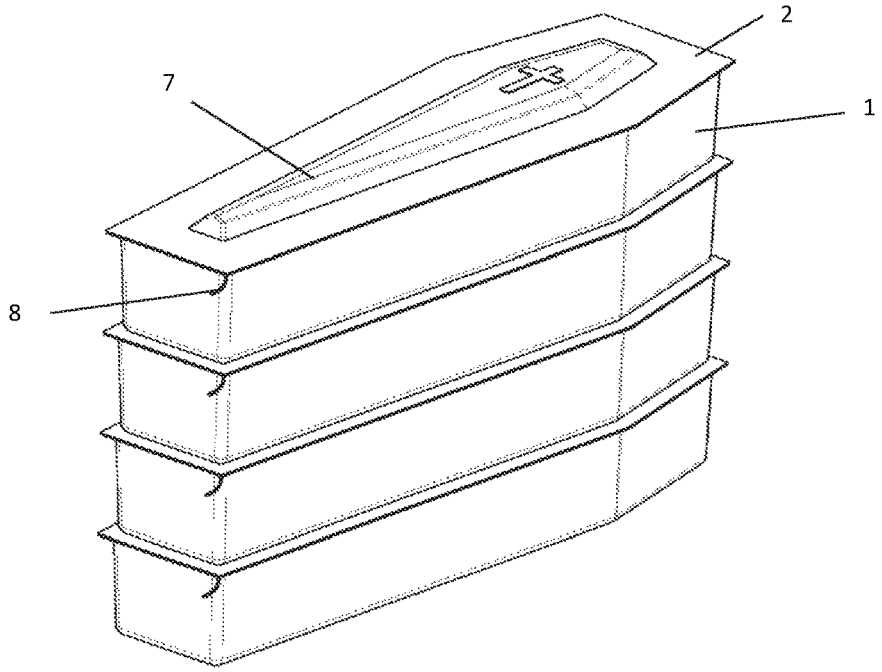
FIG. 5 shows a panoramic view of the upper portion of more housings, which can be stacked the one on the other one.

The lid 2 has on its upper surface a relief shaping 7 which serves for safe stacking and transport as well, for example, of a number of four housings at a time (FIG. 5).

The bottom 1 is molded with a sequence of four technologies. First of all, it is carried out a thermoforming for drawing with heating the plate of plastic material by means of tubular molds (frame) of ferrous material. The moulds can be differently dimensioned according to the dimensions of the housings 100 needed. Their cooling occurs by means of a cooling fluid forced inside a counter-mould in ferrous material having peripheral dimensions equal to the outside of the housing 100, with the aim of securing to the bottom 1 a perfectly flat edge 3 of about 30 mm, which serves to weld the lid 1 in order to obtain a perfectly tight housing 100. Then, there follows an injection molding step, with a steel mold, with injection of polymer granules in the recess of the mould and cooling of the polymer in the mould. Finally, it is applied the rotational molding technology which consists in introducing the plastic material in powder in a hollow mould which is rotated (generally around two axes) and heated, such that the material melts and can adhere to the walls in an homogeneously way. The following cooling occurs in the mould.

The lid 2 is molded by using different technologies in sequence too. First of all it is used vacuum thermo-forming with plate heating. Alternatively or in sequence, there can be also used a blowing thermo-forming always with plate heating. The mould is made up of an aluminum plate with flat surface and counter-mould in ferrous material having peripheral dimensions equal to the outside of the housing 100, with a perfectly flat edge portion, so that a flat edge 4, 30 mm wide, is fixed to the lid 2. Such edge serves for the welding to the bottom 1. Then, as the case of the bottom 1, there follows an injection molding step and a rotational molding step. The welding of the bottom 1 to the lid 2 is carried out by means of an original technology of electro-fusion. Between the inner peripheral edge 3 of the bottom 1 and the edge 4 of the lid 2 it is interposed a wire frame section bar 10, flat, about 10 mm wide and about 1,5 mm thick, in highly resistant metal. Said a wire frame section bar 10 is preventively configured to form the whole perimeter of the housing 100, in particular of the edge 3, 4 of the bottom or lid 2, with opened junction, so that the welding of an electric cable 8, about 100 mm long, to the two ends of the wire frame section bar 10 is allowed. The wire frame section bar 10 is then fixed to the lid 2 by means of heat welding spots with weld material. The wire frame section bar 10 is configured so that, when current passes there through, said wire frame and the outer peripheral edge of the bottom and of the lid melt together, thus providing the welding and the sealing of the peripheral edges 3,4 of the lid 2 and the bottom 1. In other words, the wire frame section bar 10 allows an extended contact between the edge 3 of the bottom 1 and the edge 4 of the lid 2 in the wire frame internal areas 11. At one end of the casing 100 the electric cables 8 protrude to a length of about 100 mm so that with a simple connection to them of a small electronic device, the current is transferred through the wire frame section bar 10 to the entire surface that must be welded.

In case the housing 100 is intended for the casket 12 interior, the welding procedure is the following: the lid as above described and with the addition of a pressure regulating valve 21, set to 0.2 bar, fixed on the outer surface by means of a mechanical attachment, is positioned on the bottom 1 of the housing 100, previously positioned inside the wooden casket 12. During the welding operation of the lid 2 to the bottom 1 it is needed that the two electric cables 8 go out from the perimeter of the housing 100, in the following the cover of the wooden casket 12 is superimposed and closed by means of self-threading screws 23 provided. In addition to sealing the casket, such an operation guarantees the sufficient contact pressure between the two peripheral surfaces of the lid 2 and the bottom 1 for a good result of the heat welding. After carrying out the above described operations, the two cable ends 8, which are outside the lid, are joined by means of a terminal board to an electronic device, for example a common rheostat, suitably designed to supply the electric current needed to make the metal insert, which will result interposed between the peripheral surfaces of the lid 2 and the bottom 1, become red. The electric energy to be developed for heating the metal resistance is equal to the electric power of the 220 Volt network energy developed by a 12/24 Volt battery.

The heat suitably developed by the metal insert will lead the contact materials to fusion. The supplying time control of the electric current is pre-set automatically and the supply will be stopped when the material fusion occurs. Then it will follow the cooling step. The materials, thus joined, will form a unique body thus guaranteeing the perfect sealing to guarantee what provided by the law (sealing for pressure up to 0.2 bar).

In the following, the electric cables 8 remained outside the housing 100 will be cut to guarantee the usual aesthetic aspect.

In case the housing 100 is provided for the transport of corpses involved in accidents, i.e. the housing 100 is not housed in the wooden casket 12, the welding procedure is similar to what previously described with the sole difference that without pressure exerted by the cover of the casket 12, the same pressure is guaranteed by means of suitable elastic clamps 24 along the whole perimeter of the housing 100.

In addition to the embodiments of the invention, as above described, it is to be intended that there exist many other variants. Further, it is to be intended that said embodiments are only example and do not limit the scope of the invention and its possible applications or configurations. On the contrary, even if the above description gives the experts in the field the possibility to realize the present invention at least according to one example configuration thereof, it is to be intended that many variations of the elements described can be made without departing from the scope of the invention encompassed by the appended claims, literally interpreted and/or legal equivalents thereof.

The invention claimed is:

1. A method for welding and sealing a housing (100) for keeping, transporting and entombing a corpse, arranged inside a casket (12), wherein said housing (100) comprising a bottom (1) with an outer peripheral edge (3) and a lid (2) with an outer peripheral edge (4), which are superimposed perfectly between each other, wherein between the edge (3) of the bottom (1) and the edge (4) of the lid (2), along the whole perimeter it is interposed a wire frame section bar (10), flat with opened junction, of highly resistant metal, wherein at the ends of the opened junction electric cables (8) are connected, said wire frame section bar (10) allows an extended contact between the edge (3) of the bottom (1) and the edge (4) of the lid (2) in the wire frame internal areas (11) of said wire frame section bar (10), thus providing by current flowing, the welding and the sealing of the peripheral edges (3, 4) of the lid (2) and the bottom (1);

said method comprising the following steps:

attaching the wire frame section bar (10) to the lid (2) of the housing (100) by means of spot welding;

positioning the lid (2) on the bottom (1) of the housing while maintaining the electric cables (8) outside the perimeter of the housing (100);

clamping the lid (2) to the bottom (1) by way of elastic clamps (24) positioned along the whole perimeter of the housing (100);

supplying electric current to the ends of the cables (8) for a predetermined time interval such that the wire frame section bar (10) and the respective contact surfaces of the lid (2) and the bottom (1) are led to fusion; and wherein the bottom (1) is positioned inside the casket (12);

removing the electric cables (8);

securing a cover of the casket to the casket (12) using a plurality of self-threading screws (23).

2. The method for welding and sealing a housing (100) arranged inside a casket (12) according to claim 1, wherein said wire frame section bar (10) has a reticular weft about 10 mm wide and about 1.5 mm thick.

3. The method for welding and sealing a housing (100) arranged inside a casket (12), according to claim 1, wherein said lid (2) comprises a pressure regulating valve (21) set to 0.2 bar.

4. The method for welding and sealing a housing (100) arranged inside a casket (12), according to claim 1, wherein said bottom (1) has on the lower surface (5) a plurality of ribs (6) which allow more housings (100) to be stacked and transported one on top of the other.

5. The method for welding and sealing a housing (100) arranged inside a casket (12), according to claim 1, wherein said lid (2) has on its upper surface a relief shaping (7) for more housing to be stacked and transported one on top of the other.

6. The method for welding and sealing a housing (100) arranged inside a casket (12), according to claim 1, further comprising two belts (13) for manually lifting and transporting the housing (100).

7. The method for welding and sealing a housing (100) arranged inside a casket (12), according to claim 1, wherein said housing (100) is made of plastic material.

* * * * *